United States Patent [19]

Krost

[11] Patent Number: 4,817,990

[45] Date of Patent: Apr. 4, 1989

[54] MULTIPLE VALUE COUPON SYSTEM

[75] Inventor: Lee Krost, Stamford, Conn.

[73] Assignee: Lee Krost Associates Inc., Stamford, Conn.

[21] Appl. No.: 96,723

[22] Filed: Sep. 14, 1987

[51] Int. Cl.[4] ..... B42D 15/00; G09F 1/08; G09F 9/00; B42F 3/00

[52] U.S. Cl. ..... 283/101; 283/51; 283/56; 283/901

[58] Field of Search ..... 283/51, 56, 72, 100, 283/101, 103, 104, 106, 108, 901; 229/70, 73, 926, 927, 928

[56] References Cited

U.S. PATENT DOCUMENTS

| | | | |
|---|---|---|---|
| 3,582,111 | 6/1971 | Siiter | 283/56 |
| 3,734,544 | 5/1973 | Fishkin et al. | 283/56 |
| 3,900,219 | 8/1975 | D'Amato et al. | 283/101 |
| 4,011,985 | 3/1977 | Simson | 283/106 |
| 4,033,611 | 7/1977 | Johnsen | 283/901 |
| 4,110,502 | 8/1978 | Baer | 283/51 |
| 4,195,864 | 4/1980 | Morton et al. | 283/56 |
| 4,307,908 | 12/1981 | Krautsack | 283/56 |
| 4,685,699 | 8/1987 | Hirasawa | 283/51 |

FOREIGN PATENT DOCUMENTS 2414765 8/1979 France .

OTHER PUBLICATIONS

Irish Spring Coupon, ICIG-Washington Post Issue, Sep. 21, 1972.

Sara Lee Coupon, E8-Washington Post Issue Nov. 7, 1974.

*Primary Examiner*—Frank T. Yost

*Assistant Examiner*—Paul M. Heyrana, Sr.

*Attorney, Agent, or Firm*—Felfe & Lynch

[57] ABSTRACT

A multiple retail coupon and a means for using it to identify and persuade a user of a competitive product to convert to a sponsoring manufacturer's product is disclosed. In particular, an upper sheet is adhered to a lower sheet, the upper sheet having a center section and division lines defining at least one pair of rectangular sections. End sections of each of the rectangular sections correspond to the center section. Cooperating printed matter is provided on an inner face of the lower sheet so that a consumer selecting one of the rectangles will ascertain a value of the sponsor's product which is redeemable. A consumer of a competitor's product will receive a higher value than a consumer of a sponsor's product to persuade the competitive consumer to convert to the desired product.

15 Claims, 3 Drawing Sheets

FIG.1
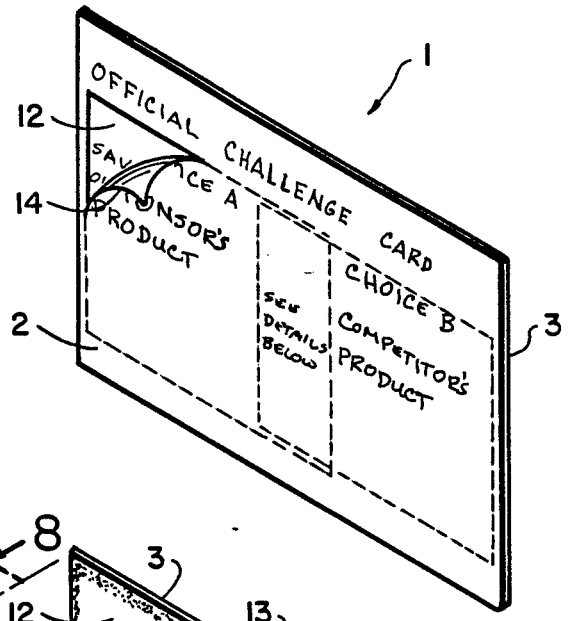
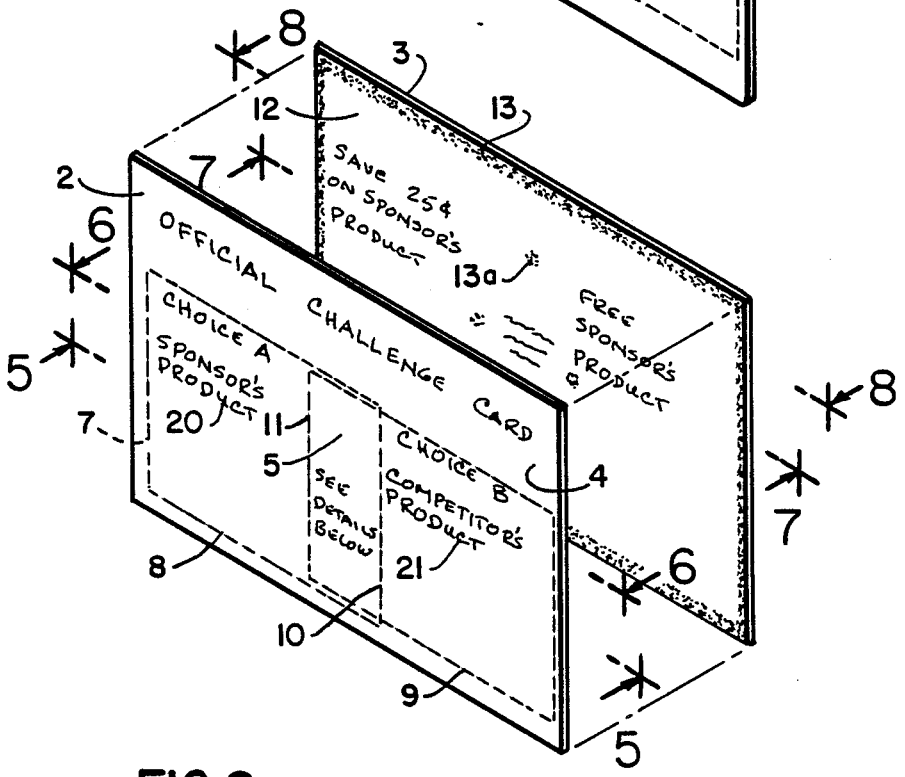
FIG.2

MULTIPLE VALUE COUPON SYSTEM

FIELD OF THE INVENTION

The present invention relates to a retail coupon document having a multiple of sections whose corresponding values are not ascertainable by a consumer until selection of one of the sections is made, the selection of one section negating the alternative section's value to thus eliminate double redemption of nonselected coupon values. More particularly, the selection of one of the sections enables a sponsoring manufacturer to target users of a competitor's products and to simultaneously provide an offer incentive to persuade the consumer to convert to the sponsor's product.

BACKGROUND OF THE INVENTION

Sponsors of consumer products are continually developing means for identifying consumers who use its competitor's products (i.e. competitive users) and to convert their use to a desired product.

Prior art methods of achieving these goals have been, on the whole, time consuming and expensive. For example, manufacturers have tried to identify competitive users by questionnaires, phone surveys, random studies or consumer lists purchased from other sources. Once the competitive users are identified, promotional stimuli, such as coupons are sent to the users to provide the potential purchasers with a strong incentive to buy the desired product and to convert from the competitive brand. Not only is this two step process very expensive, but there is a valuable time delay between the identification of a potential consumer and the impact on the consumer to convert to the desired product.

Another less focused process for identifying such users includes mass distribution of retail coupons for a sponsor's product and a hit and miss return as to whether the redeemed coupons will identify a competitive user or a user of the product being promoted.

SUMMARY OF THE INVENTION

It is therefore an object of the present invention to provide a multiple retail coupon document whose values are ascertainable by a user who at the same time identifies himself as either a competitive or non-competitive consumer.

It is a further object of the invention to target for a sponsoring manufacturer a significant economic purchase incentive for the desired product as opposed to the product of its primary competition.

To achieve these and other goals which will become evident, the subject invention includes a coupon document having an upper sheet adhesively joined to a lower sheet. On an outer face of the upper sheet, a rectangular center section having printed matter thereon is provided adjacent to a plurality of end sections which are defined by division lines. The lines of division are arranged to provide a number of rectangles, each rectangle containing the end sections and the center section within its borders. In the preferred embodiment a pair of rectangular sections are provided with printing matter describing possible choices available to the consumer. Corresponding to each rectangle is printed matter on the inner face of the lower sheet of the coupon which defines the redeemable value for each of the available rectangles, one of the rectangles having a lower value than the other rectangle of the pair. The coupon is further arranged so that once a user chooses a rectangular section the remaining rectangle choices are void and the value received by the consumer is reversibly selected.

BRIEF DESCRIPTION OF THE DRAWINGS

FIG. 1 is a perspective view of the multiple retail coupon document according to the invention.

FIG. 2 is an exploded front view in perspective of the sheet components of the coupon.

DETAILED DESCRIPTION OF THE PREFERRED EMBODIMENT

Figure 3:
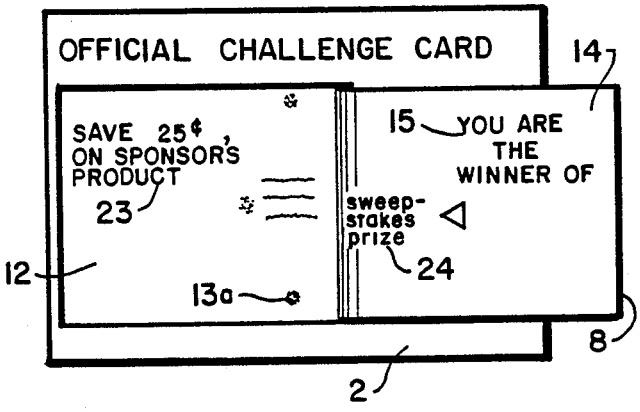
FIG. 3 is a partial view of the printed matter on the inner face of the upper sheet and a partial view of the matter of the inner face of the lower sheet indicating a single value corresponding to a rectangle choice of the consumer.

As illustrated in FIG. 1, the preferred embodiment of the inventive coupon 1 includes an upper sheet 2 attached to a lower sheet 3 to form a card like insert having a double stock thickness. An adhesive means 13 should be chosen to ensure that the upper sheet 2 is not easily removed from the lower sheet 3. Any adhesive means 13 which will accomplish this purpose and is known in the art may be used. Additionally glue spots 13*a* are preferably included on the inner face of the lower sheet 3 to removably hold the two sheets together in the center of the card.

On an outer face 4 of the upper sheet 2, a center section 5 with printed matter 6 thereon is provided. Division lines 7 are also provided on the outer face 4 to define at least one pair of rectangular sections 8, 9. The end section 10 of rectangle 8 and the end section 11 of rectangle 9 are each adjacent to a side of the center section 5. In this manner, a user removes either rectangular section 8 or rectangular section 9, but in either case must include the center section 5 with his choice.

The division lines 7 are preferably printed in different colors to define the different rectangular sections 8, 9. Any means known in the art of providing division lines may be used as long as the means require that the center section 5 be removed with the user's choice.

As illustrated in FIG. 2, an inner face 12 of the lower sheet 3 contains printed matter indicating at least one pair of values which are ascertainable by the consumer. For example, a sponsoring manufacturer may provide a discounted price for its product for one of the values paired with a free sample of the sponsor's product as the second value.

In addition to values redeemable on a product, the coupon 1 may contain printed matter for additional awards. As illustrated in FIG. 3, an inner face 14 of the upper sheet 2 may contain printed matter 15 indicating a sweepstakes prize. In the preferred embodiment, the sweepstakes prize is described on the inner face 14 of the center section 5. By this means, the end section 5 must be included in the rectangular section 8 or 9 chosen by the user and the user's selection is irreversible as the selection of one section 8 renders the corresponding section 9 valueless. It is to be understood that the printed matter 23 and 25 describing the selected value of the sponsor's product may be positioned on the inner face 14 of the upper sheet 2 and the sweepstakes prize matter 15 and 24 be provided on the inner face 12 of the lower sheet 3. Moreover the sweepstakes prize matter 15 and 24 may be wholly eliminated and replaced with printed matter describing a second set of discount coupons instead, so that a prize 24 need not be offered.

On an outer face 16 of the lower sheet 3 printed matter 17 corresponding to contest rules, sweepstakes rules, etc. may be provided.

To utilize the coupon to both identify a competitive user and persuade the user to convert to a particular product, a sponsoring manufacturer provides printed matter 20 regarding the sponsor's product on the rectangular section 8 of upper sheet 2 and printed matter 21 regarding a competitor's product on the rectangular section 9. The printed matter on rectangular 8 further includes the description choice A verses the printed matter on rectangular section 9 described as choice B. Division lines 7 defining rectangular section 8 may be provided in red ink, while division lines for rectangular section 9 may be provided in blue ink to provide contrast between the pair of sections 8, 9.

A consumer of the sponsor's product, would select and cut out section 8 to uncover printed matter 23 on the lower sheet 3 to ascertain that a lower retail value, such as a discount price on the sponsor's product is available. In so doing the corresponding rectangular section 9 would be rendered valueless.

Additionally, a sweepstakes prize, such as perfume, a trip, an appliance, etc. may be indicated by printed matter 24 on the inner face of rectangular section 8 as illustrated in FIG. 3.

Figure 4:
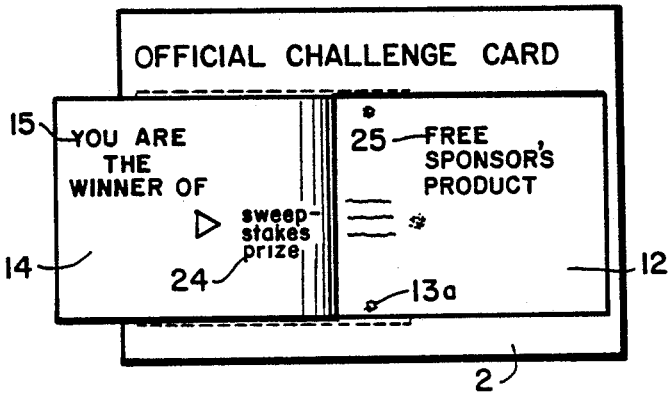
FIG. 4 is a partial view of the printed matter on the inner face of the upper sheet and a partial view of the printed matter on the inner face of the lower indicating a second value corresponding to a second rectangle choice of the consumer.
Figure 5:
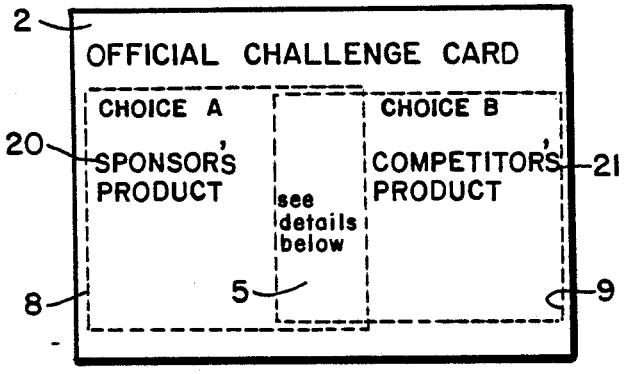
FIG. 5 is a front view of the outer face of the upper sheet of the inventive coupon.
Figure 6:
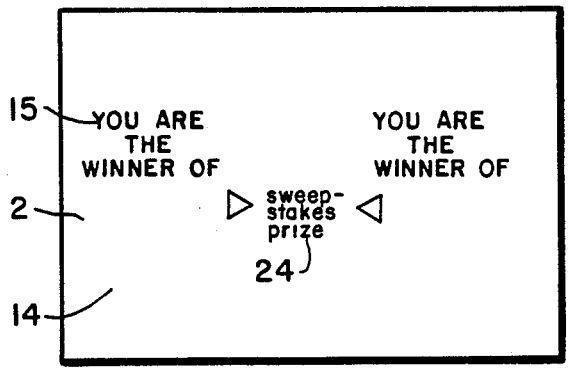
FIG. 6 is a view of the inner face of the upper sheet taken along lines 6—6 of FIG. 2.

In contrast, should a user choose the competitive product, rectangular section 9 would be cut-out and printed matter 25 describing a higher retail value for the sponsor's product would be uncovered and provided to the potential user as illustrated in FIG. 4. The sweepstakes prize 24 described on the inner face of rectangular section 9 may be the same prize as that provided on the inner face of rectangular section 8. By this means a user of a competitive product is stimulated to try the sponsor's product at a nominal cost or at no cost.

Since the end section 5 must be included in either choice of rectangular section 8 or 9, once the consumer has made his selection, the value of the corresponding rectangular section is destroyed.

Figure 7:
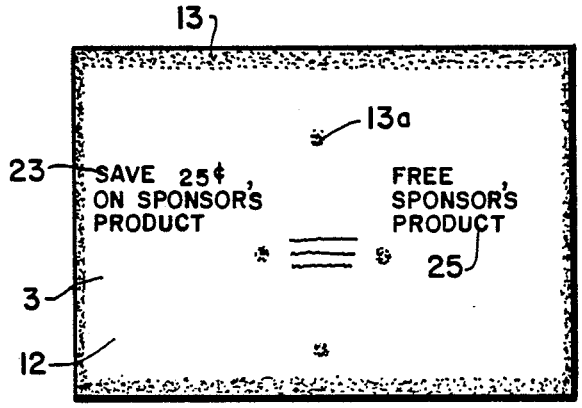
FIG. 7 is a front view of the inner face of the lower sheet taken along lines 7—7 of FIG. 2.
Figure 8:
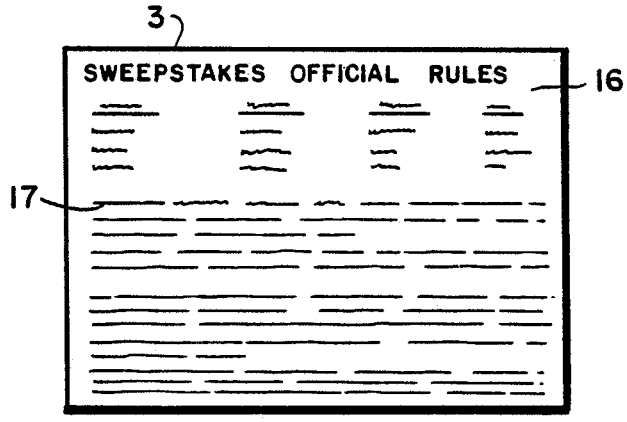
FIG. 8 is a back view of the outer face of the lower sheet.

In a further preferred embodiment, instructions to the consumer and/or the merchant for use of the coupon may be provided on the inner face 12 of the lower sheet 3 in a space 26 corresponding to the inner face of the end section 5 on the upper 2 (e.g. FIG. 7).

The insert card form of the coupon 1 can be free standing or preferably distributed in mass circulation in materials such as magazines, newspapers, direct mail, etc. A perforation line may be provided near a margin of the coupon 1 which is inserted into a magazine's binding.

It will be understood that the specification and examples are illustrative, but not limitative of the present invention and that other embodiments within the spirit and scope of the invention will suggest themselves to those skilled in art.

What is claimed is:

1. A multiple retail coupon document comprising an upper sheet and a lower sheet separably joined together around their edges by an adhesive, the upper sheet having an outer face with a rectangular center section, a plurality of end sections defined by lines of division, each end section being adjacent a side of the center section and bearing indicia defining a product, the lines of division being arranged to provide a rectangle encompassing a single end section and the center section, and, the lower sheet having an inner face with cooperating printed matter disposed in such a manner as to indicate a value of a product upon cutting a rectangle comprising an end section and the center section, the value not being ascertainable until said rectangle is cut.

2. A multiple retail coupon document according to claim 1 in which the cooperating printed matter indicates that the document is valueless if the center section is not included in the cut-out rectangle.

3. A multiple retail coupon document according to claim 2 in which the cooperating printed matter is rendered incomprehensible if the center section is not included in the cut-out rectangle.

4. A multiple retail coupon document according to claim 1 in which the values provided by the cooperating printed matter differ according to the particular end section included in the cut-out rectangle.

5. A multiple retail coupon document according to claim 4 in which the cooperating printed matter provides discounts for one of the products defined on an end section.

6. A multiple retail coupon document according to claim 5 in which both inner faces have the cooperating printed matter.

7. A multiple retail coupon document according to claim 5 in which additionally has, on the inner face not having the cooperating printed matter, a certificate relating to a sweepstakes prize, said certificate being rendered valueless if the center section is not included in the cut-out rectangle.

8. A multiple retail coupon document according to claim 7 in which the cooperating printed matter is printed on the inner face of the lower sheet and the certificate is printed on the inner face of the upper sheet.

9. A dual value retail discount coupon document according to claim 8 in which the cooperating printed matter is printed on the inner face of the lower sheet and the certificate is printed on the inner face of the upper sheet.

10. A dual value retail discount coupon document according to claim 7 in which additionally has, on the inner face not having the cooperating printed matter, a certificate relating to a sweepstakes prize, said certificate being rendered valueless if the center section is not included in the cut-out rectangle.

11. A dual value retail discount coupon document comprising an upper sheet and a lower sheet joined together around the edges;

the outer face of the upper sheet having a rectangle center section;

two detachable end sections defined by lines of division;

the end sections being adjacent opposite sides of the center section and bearing indicia defining a product;

the lines of division being arranged to provide a rectangle encompassing a single end section and the center section;

and, on an inner face of said coupon document, cooperating printed matter disposed in such manner as to indicate, upon cutting a rectangle comprising an end section and the center section, a different discount value according to the particular end section included and to indicate that the coupon is valueless if the center section is not included the discount values not being ascertainable until said rectangle is cut.

12. A dual value retail discount coupon document according to claim 11 which is bound into a magazine as a separate detachable page.

13. A method for manufacturing and using a multiple retail coupon document having redemption value determined by a retail consumer comprising:

(a) printing an outer face of an upper sheet having a rectangular center section and a plurality of end sections defined by lines of division, each end section being adjacent a side of the center section and bearing indicia defining a product, the lines of division been arranged to provide a rectangle encompassing a single end section and the center section;

(b) printing an inner face of a lower, sheet with printed matter having at least two assigned values for a product;

(c) adhering, said upper sheet to said lower sheet to form a double thickness insert card;

(d) distributing said insert cards in a mass distribution to consumers;

(e) selecting a rectangle on said outer face of the upper sheet which corresponds to one of said pair of values provided on the inner face of the lower sheet; and (f) redeeming said selected value through retail establishments.

14. The method for manufacturing and using said coupon according to claim 13 wherein the selecting of the rectangle step renders the other value of said values valueless.

15. The method for manufacturing and using said multiple retail coupon document according to claim 13 further comprising printing an additional award on an inner face of said upper sheet corresponding to said rectangle, and ascertaining the award at the same time the value of said rectangle is selected by the consumer.

* * * * *